US009192833B2

(12) United States Patent
Margoles et al.

(10) Patent No.: US 9,192,833 B2
(45) Date of Patent: Nov. 24, 2015

(54) GOLF CLUB WITH IMPROVED WEIGHT DISTRIBUTION

(71) Applicant: Acushnet Company, Fairhaven, MA (US)

(72) Inventors: Ryan Margoles, Cardiff, CA (US); Gregory D. Johnson, Vista, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 14/248,556

(22) Filed: Apr. 9, 2014

(65) Prior Publication Data

US 2014/0221121 A1 Aug. 7, 2014

Related U.S. Application Data

(62) Division of application No. 13/335,531, filed on Dec. 22, 2011, now abandoned.

(51) Int. Cl.
*A63B 53/14* (2015.01)
*A63B 53/16* (2006.01)

(52) U.S. Cl.
CPC ..... *A63B 53/145* (2013.01); *A63B 53/16* (2013.01)

(58) Field of Classification Search
CPC ..... A63B 53/16
See application file for complete search history.

(56) References Cited

U.S. PATENT DOCUMENTS

| | | | | |
|---|---|---|---|---|
| 1,167,387 | A | | 1/1916 | Daniel |
| 1,831,255 | A | | 11/1931 | Menzies |
| 2,051,083 | A | | 8/1936 | Hart |
| 2,782,035 | A | | 2/1957 | East |
| 2,992,828 | A | | 7/1961 | Stewart |
| 3,075,768 | A | | 1/1963 | Karns |
| 3,270,564 | A | | 9/1966 | Evans |
| 3,606,327 | A | | 9/1971 | Gorman |
| 3,792,863 | A | | 2/1974 | Evans |
| 3,945,646 | A | | 3/1976 | Hammond |
| 4,461,479 | A | | 7/1984 | Mitchell |
| 4,674,746 | A | | 6/1987 | Benoit |
| 4,690,407 | A | | 9/1987 | Reisner |
| 4,887,815 | A | * | 12/1989 | Hughes et al. ..... 473/291 |
| 4,936,586 | A | | 6/1990 | Van Raemdonck |
| 4,988,102 | A | | 1/1991 | Reisner |
| 5,152,527 | A | | 10/1992 | Mather et al. |
| 5,244,209 | A | | 9/1993 | Benzel |
| 5,351,952 | A | | 10/1994 | Hackman |
| 5,465,967 | A | | 11/1995 | Boeckenhaupt |
| 5,474,298 | A | | 12/1995 | Lindsay |
| 5,569,099 | A | | 10/1996 | Jackson |
| 5,575,722 | A | | 11/1996 | Saia et al. |
| 5,591,091 | A | | 1/1997 | Hackman |
| 5,638,300 | A | | 6/1997 | Johnson |
| 5,716,289 | A | | 2/1998 | Okoneski |
| 5,792,000 | A | | 8/1998 | Weber et al. |

(Continued)

FOREIGN PATENT DOCUMENTS

| | | | |
|---|---|---|---|
| JP | 2012-016560 | A | 1/2012 |

*Primary Examiner* — Michael Dennis
(74) *Attorney, Agent, or Firm* — Kevin N. McCoy

(57) ABSTRACT

A golf club with improved weight distribution is disclosed herein. More specifically, the present invention discloses a golf club with a lightweight shaft allowing the golfer to achieve higher swing speed, while shifting the weight savings of the shaft to a grip portion of the club; counterbalancing some of the undesirable performance characteristics associated with a lightweight shaft.

10 Claims, 5 Drawing Sheets

(56) References Cited

U.S. PATENT DOCUMENTS

| | | | | |
|---|---|---|---|---|
| 5,803,823 | A | 9/1998 | Gobush et al. | |
| 5,810,676 | A | 9/1998 | Bird | |
| 5,823,878 | A | 10/1998 | Welch | |
| 5,984,804 | A | 11/1999 | Berg | |
| 6,007,431 | A | 12/1999 | Bloom, Jr. | |
| 6,083,123 | A | 7/2000 | Wood | |
| 7,874,944 | B2 | 8/2001 | Handke | |
| 6,302,802 | B1 | 10/2001 | Pao | |
| 6,364,787 | B1 | 4/2002 | Huiskamp | |
| 6,441,745 | B1 | 8/2002 | Gates | |
| 6,514,081 | B1 | 2/2003 | Mengoli | |
| 6,572,490 | B2 | 6/2003 | Ashida | |
| 6,626,768 | B2 | 9/2003 | Roelke | |
| 6,966,846 | B2 | 11/2005 | Bloom, Jr. | |
| 6,988,968 | B2 | 1/2006 | Okamoto | |
| 7,041,014 | B2 | 5/2006 | Wright et al. | |
| 7,154,100 | B2 | 12/2006 | Spartiotis et al. | |
| 7,171,027 | B2 | 1/2007 | Satoh | |
| 7,195,565 | B2 | 3/2007 | White et al. | |
| 7,219,033 | B2 | 5/2007 | Kolen | |
| 7,261,641 | B2 | 8/2007 | Lindner | |
| 7,264,554 | B2 | 9/2007 | Bentley | |
| 7,264,555 | B2 | 9/2007 | Lee et al. | |
| 7,267,619 | B1 | 9/2007 | Pettis | |
| 7,381,139 | B2 | 6/2008 | Weeks et al. | |
| 7,399,235 | B2 | 7/2008 | Gill et al. | |
| 7,399,236 | B2 | 7/2008 | Takeuchi | |
| 7,458,902 | B2 * | 12/2008 | Gill | A01K 87/08 473/299 |
| 7,481,716 | B1 | 1/2009 | Johnson | |
| 7,500,921 | B2 | 3/2009 | Cheng | |
| 7,545,434 | B2 | 6/2009 | Bean et al. | |
| 7,635,310 | B2 | 12/2009 | Keough | |
| 7,686,701 | B2 | 3/2010 | Hasegawa | |
| 7,693,415 | B2 | 4/2010 | Shiohara | |
| 7,699,718 | B2 | 4/2010 | Lindner | |
| 7,704,157 | B2 | 4/2010 | Shirai et al. | |
| 7,704,160 | B2 | 4/2010 | Lindner | |
| 7,704,161 | B2 * | 4/2010 | Lindner | A63B 53/00 473/297 |
| 7,744,480 | B2 | 6/2010 | Gobush | |
| 7,798,911 | B2 | 9/2010 | Gill | |
| 7,804,998 | B2 | 9/2010 | Mündermann et al. | |
| 7,870,790 | B2 | 1/2011 | Sato et al. | |
| 7,887,440 | B2 | 2/2011 | Wright et al. | |
| 7,909,705 | B2 | 3/2011 | Gill et al. | |
| 7,997,997 | B2 | 8/2011 | Bennett et al. | |
| 8,118,687 | B1 | 2/2012 | Galloway | |
| 8,150,248 | B1 | 4/2012 | Woodman | |
| 8,177,658 | B1 | 5/2012 | Johnson | |
| 8,216,085 | B2 | 7/2012 | Fujimoto | |
| 8,221,257 | B2 | 7/2012 | Davenport | |
| 8,257,191 | B2 | 9/2012 | Stites et al. | |
| 8,313,392 | B2 | 11/2012 | White | |
| 8,335,669 | B2 | 12/2012 | Shimizu et al. | |
| 8,444,502 | B2 * | 5/2013 | Karube | 473/297 |
| 8,475,300 | B2 | 7/2013 | Ueda | |
| 8,556,267 | B2 | 10/2013 | Gobush | |
| 8,595,312 | B2 | 11/2013 | Robles Gil Daellenbach et al. | |
| 8,636,605 | B2 | 1/2014 | Rose | |
| 8,657,707 | B2 | 2/2014 | Ueda et al. | |
| 8,668,595 | B2 | 3/2014 | Boyd et al. | |
| 2002/0173364 | A1 | 11/2002 | Boscha | |
| 2003/0109335 | A1 | 6/2003 | Dineen et al. | |
| 2004/0138000 | A1 | 7/2004 | Braly et al. | |
| 2005/0054459 | A1 | 3/2005 | Oldenburg | |
| 2006/0084516 | A1 | 4/2006 | Eyestone et al. | |
| 2006/0166737 | A1 | 7/2006 | Bentley | |
| 2012/0052973 | A1 | 3/2012 | Bentley | |
| 2012/0100923 | A1 | 4/2012 | Davenport | |
| 2012/0157241 | A1 | 6/2012 | Nomura et al. | |
| 2012/0214606 | A1 | 8/2012 | Ueda | |
| 2012/0277016 | A1 | 11/2012 | Boyd et al. | |
| 2012/0277017 | A1 | 11/2012 | Boyd et al. | |
| 2012/0277018 | A1 | 11/2012 | Boyd et al. | |
| 2012/0286114 | A1 | 11/2012 | Jertson et al. | |
| 2012/0289354 | A1 | 11/2012 | Cottam et al. | |
| 2012/0302364 | A1 | 11/2012 | Boccieri | |
| 2013/0041590 | A1 | 2/2013 | Burich et al. | |
| 2013/0143687 | A1 * | 6/2013 | Stafford | 473/300 |
| 2013/0165249 | A1 | 6/2013 | Margoles et al. | |
| 2013/0344973 | A1 | 12/2013 | Margoles et al. | |

* cited by examiner

GOLF CLUB WITH IMPROVED WEIGHT DISTRIBUTION

RELATED APPLICATIONS

The current application is a divisional of U.S. patent application Ser. No. 13/335,531 to Ryan Margoles et al., Golf Club with Improved Weight Distribution, filed Dec. 22, 2011, currently pending, the disclosure of which is incorporated herein by reference in its entirety.

FIELD OF THE INVENTION

The present invention relates generally to a golf club with improved weight distribution. More specifically, the present invention relates to a golf club with a lightweight shaft allowing the golfer to achieve higher swing speed, while shifting the weight savings of the shaft to the grip portion of the golf club to counterbalance some of the undesirable performance characteristics associated with a lightweight shaft. The golf club achieves this improved weight distribution by providing a golfer with a lighter weighted golf club shaft than he or she is normally used to, but addresses the undesirable side effects of such a lightweight shaft by incorporating a weight adjustment member near the grip portion of the golf club. This improved weight distribution allows the golfer to achieve a much faster clubhead speed by lightening the weight that needs to be exerted by the golfer without the undesirable intangible drawbacks of a lightweight shaft such as diminished feel and diminished accuracy.

BACKGROUND OF THE INVENTION

In order to create golf clubs that help the golfer achieve a better score, golf club designers have made numerous technological advancements in creating a golf club that is easier to hit. Technological advances such as metalwood drivers, cavity back irons, and even graphite shafts throughout the years have all made the game of golf much easier for your average golfer in helping them hit the golf ball longer and straighter. However, despite all the technical advancements in the game of golf, the biggest variation in a golf swing is often the golfer itself. In fact, a golf swing is so unique to each individual golfer, it can be argued that no two golfers may have identical golf swings.

In order to address the often diverging needs of the different swings associated with different golfers, golf club designers make different models of golf clubs that have different performance characteristics to help golfers get more performance out of their particular golf swing. More specifically, golf club designers often create different models of golf club heads having different size, shape, and geometry, allowing various golfers to select from the model that suits their game the most. Similarly, golf shaft designers often create different models of golf shafts having different weight, flex, and materials to provide the golfer even more extensive variety to truly allow a golfer to select what works best for his or her golf swing.

With respect to golf club shafts, the general trend, based on the preference of the golfers, is that golfers with higher swing speeds, due to their increased strength, better technique, and/or quick velocity, tend to prefer a stiffer shaft that is heavier in weight. Alternatively, golfers with slower swing speeds, due to their lack of strength, poor technique, and/or slower velocity, tends to gravitate towards weaker shafts that is lighter in weight.

Despite the general preferences of the groups of golfers, the laws of physics still governs the golf swing, meaning that a lighter shaft with a lighter overall weight, should, in theory, be able to be swung faster than a heavier shaft with more overall weight. U.S. Patent Publication No. 2004/0138000 to Braly et al. confirms this phenomenon by first recognizing that an ideal golf club shaft should be minimal in weight, creating a unique lightweight and durable golf club shaft. U.S. Pat. No. 5,810,676 to Bird also affirms the general understanding about weighting of a golf club shaft, and teaches a lightweight shaft using non-metallic composite materials of a given density including graphite fibers and cured epoxy resin.

The problem with lightweight shafts is that the advantage in creating more golf club head speed from the weight reduction is often offset, if not completely negated by the loss in accuracy and feel of the golf club. Hence, despite the apparent advantage of a lightweight shaft, the better golfers with higher swing speeds are not capable of taking advantage of this increased clubhead speed due to the dramatic lost in feel and accuracy when a strong golfer swings a lightweight shaft. Correlatively, weaker golfers with slower swing who already swing a lightweight shaft, can also benefit from a further reduction in the weight of the shaft; if there was a way for them to minimize the adverse effect of lost in feel and accuracy.

Hence, it can be seen that there is a need in the field for a golf club that can take advantage of a lightweight shaft without sacrificing feel, accuracy, and dispersion. In order to achieve this, the current invention seeks to manipulate the weight removed from the shaft portion of the golf club and reposition it near the grip end of the golf club to achieve a relationship that doesn't jeopardize the feel, accuracy, and dispersion of the golf shot.

BRIEF SUMMARY OF THE INVENTION

In one aspect of the present invention is a golf club comprising a club head located a distal end of the golf club, a grip located at a proximal end of the golf club, a shaft juxtaposed between the club head and the grip, connecting the club head to the grip, and a weight adjustment member attached to a proximal end of the grip. The club head has a mass of between about 170 grams to about 225 grams, the grip has a grip mass of between about 25 grams to about 60 grams with said grip having a grip density ($Density_{grip}$) of between about 2.0 grams/inch and about 5.0 grams/inch, and the shaft has a shaft mass of less than about 40% of the club head mass yielding a shaft density ($Density_{shaft}$) of between about 1.0 grams/inch and about 2.0 grams/inch; wherein the weight adjustment member has a mass determined based on the relationship $$Mass_{wam} = F * \left(\frac{Density_{grip}}{Density_{shaft}}\right),$$

with a factor of adjustment (F) of between about 2 to about 20.

In another aspect of the present invention is a golf club comprising a club head located a distal end of the golf club, a grip located at a proximal end of the golf club, a shaft juxtaposed between the club head and the grip, connecting the club head to the grip, and a weight adjustment member attached to a proximal end of the grip. The club head has a mass of between about 170 grams to about 225 grams, the grip has a grip mass of between about 25 grams to about 60 grams with said grip having a grip density ($Density_{grip}$) of between about 2.0 grams/inch and about 5.0 grams/inch, and the shaft has a shaft mass of less than about 40% of the club head mass yielding a shaft density ($Density_{shaft}$) of between about 1.0 grams/inch and about 2.0 grams/inch; wherein said weight adjustment member has a mass of between about 15 grams to about 100 grams.

In a further aspect of the present invention is a method of fitting comprising the step of reducing the mass of a shaft portion of a golf club, adding mass toe a grip portion of a golf club via a weight adjustment member, adjusting a center of gravity of the mass added to the grip portion of the golf club, and adjusting the face angle of the golf club via an adjustable hosel mechanism. The mass of the weight adjustment member added to the grip portion of the golf club is based on the relationship $$Mass_{wam} = F * \left( \frac{Density_{grip}}{Density_{shaft}} \right),$$

with a factor of adjustment (F) of between about 2 to about 20.

These and other features, aspects and advantages of the present invention will become better understood with references to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
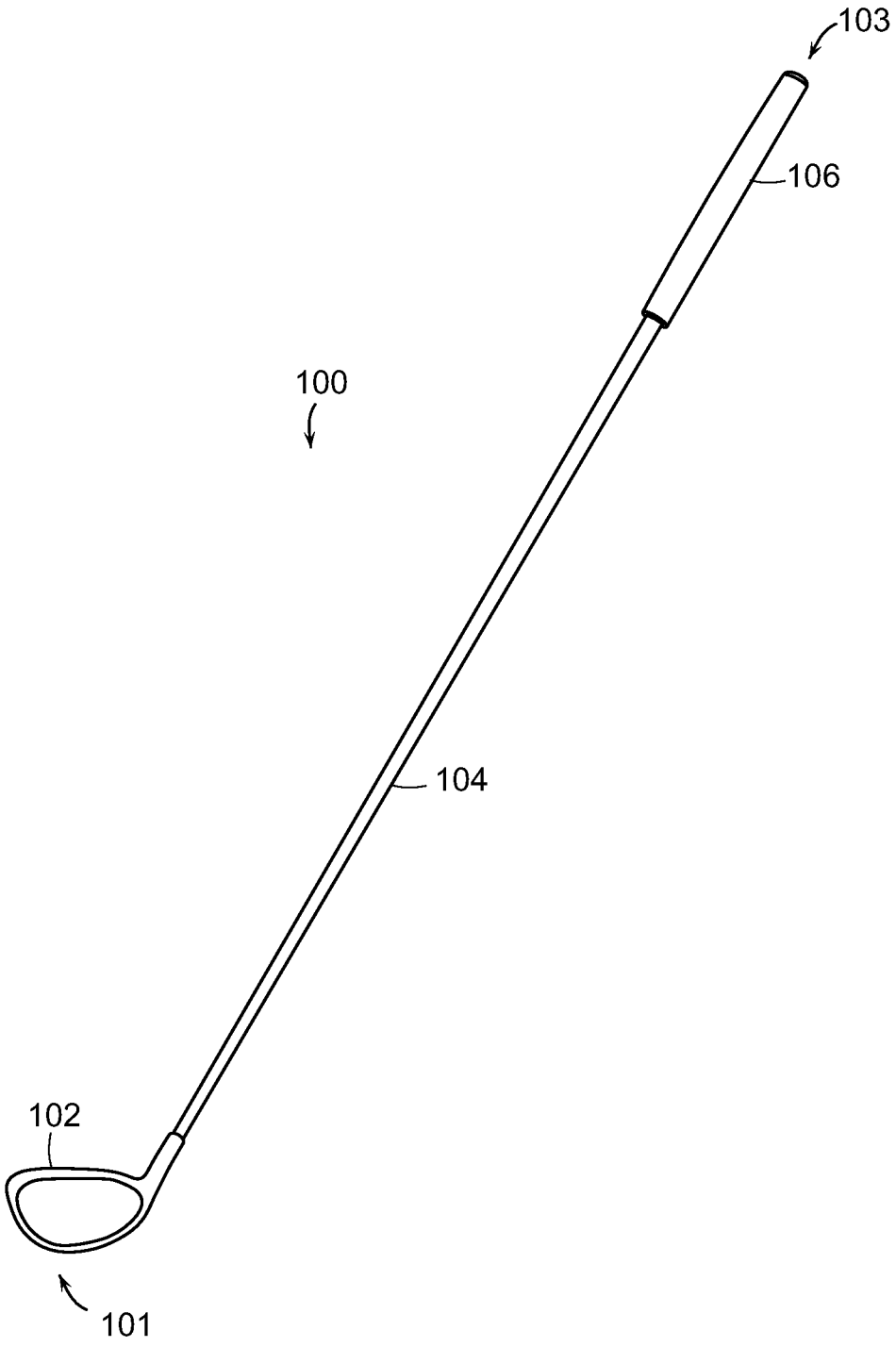
FIG. 1 of the accompanying drawings provides a perspective view of a golf club in accordance with an exemplary embodiment of the present invention.

FIG. 1 of the accompanying drawings shows a perspective view of a golf club 100 in accordance with an exemplary embodiment of the present invention. More specifically, FIG. 1 shows a golf club 100 further comprising of a club head 102 at a distal end 101 of the golf club 100, a grip 106 at a proximal end 103 of the golf club 100, and a shaft 104 juxtaposed between the club head 102 and the grip 106 connecting said grip 106 to said club 102. The club head 102, as referred to in the current embodiment of the present invention, may generally refer to a metalwood type golf club head 102; however, in alternative embodiments of the present invention, club head 102 may refer to iron type golf club heads, wedge type golf club heads, or even putter type golf club heads all without departing from the scope and content of the present invention. The shaft 104, as referred to in the current exemplary embodiment of the present invention, may generally refer to a lightweight graphite type material; however, the shaft 104 may be made out of a metallic material, a rubber material, wooden material, or any other type of material capable of creating a connection between the club head 102 and the grip 106 all without departing from the scope and content of the present invention. Finally, the grip 106, as referred to in this current exemplary embodiment may generally be made out of a rubber composite type material, however numerous other materials such as leather, plastic, or even composite material may be used without departing from the scope and content of the present invention.

Figure 2:
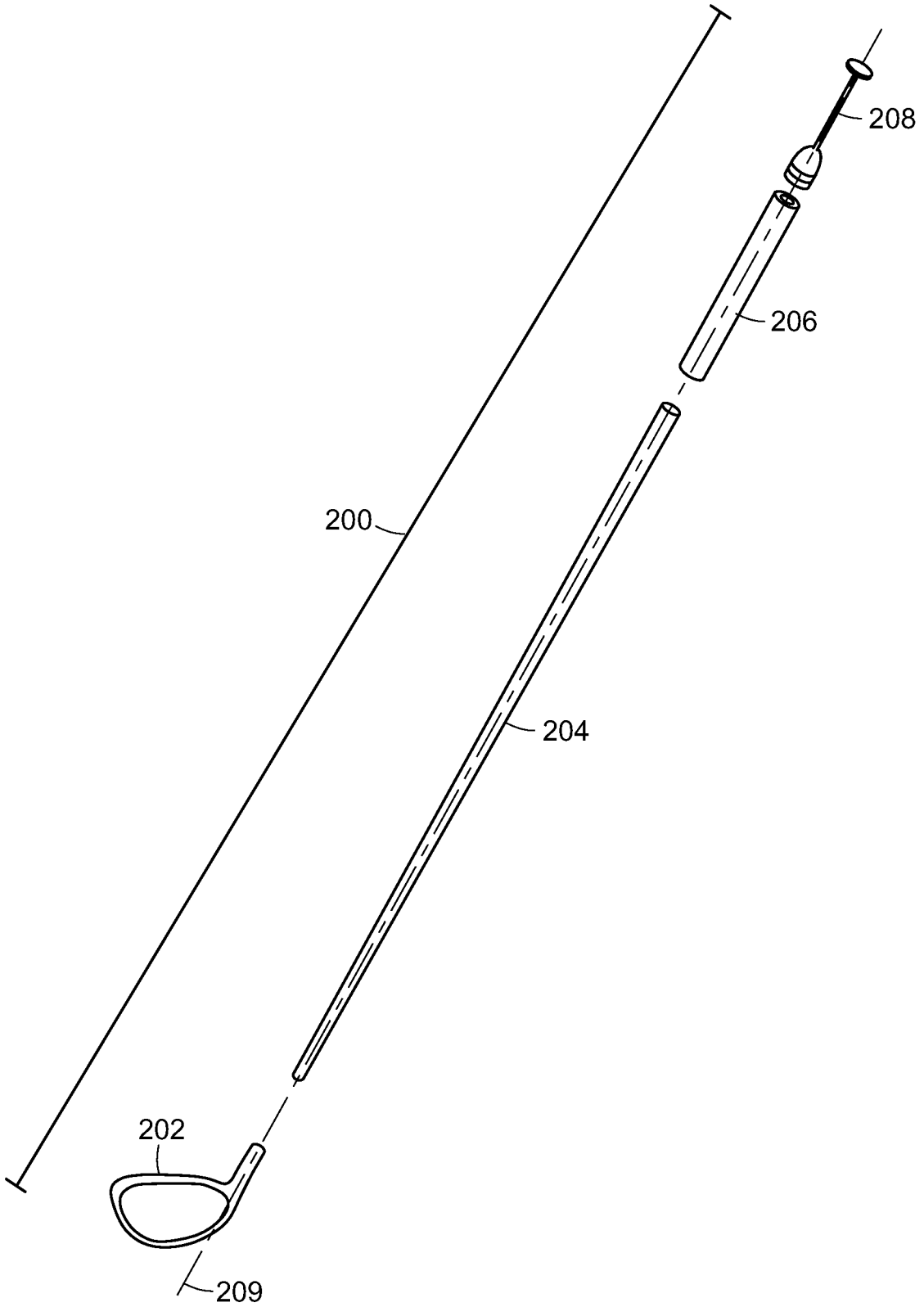
FIG. 2 of the accompanying drawings provides an exploded perspective view of a golf club in accordance with an exemplary embodiment of the present invention.

In order to understand the improved weight distribution of the current inventive golf club 100, it is worthwhile to dive into the weight of the each of the various components involved in the golf club 100 itself For that, FIG. 2 of the accompanying drawings shows an exploded view of a golf club 200 in accordance with the present invention to allow the various components to be shown with more clarity. More specifically, the exploded view of the golf club 200 allows the weight adjustment member 208 to be shown in more detail in conjunction to the previously described components of the club head 202, the shaft 204, and the grip 206.

In this current exemplary embodiment of the present invention, the club head 202 may generally have a mass of between about 170 grams to about 225 grams, more preferably between about 180 grams to about 215 grams, and most preferably between about 190 grams to about 205 grams in accordance with the common weight associated with a metalwood driver type golf club head. The grip 206, similar to the club head 206, is in line with industry standard and has a mass of between about 25 grams to about 60 grams, more preferably between about 35 grams to about 55 grams, and most preferably between about 45 grams to about 52 grams. Although the weight of the club head 202 and the grip 206 do not deviate much from normal industry standards, the weight of the shaft 204 is significantly lighter than what is the industry standard. In fact, the mass of the shaft 204 in the current exemplary embodiment is generally less than about 40% of the mass of the club head 202, more preferably less than about 35% of the mass of the club head 202, and most preferably less than about 30% of the mass of the club head 202 to yield a shaft mass of less than about 90 grams, more preferably less than about 75 grams, and most preferably less than about 60 grams.

Before moving onto the discussion about the mass of the weight adjustment member 208, it is worthwhile to calculate the density of the shaft 204 and the density of the grip 206; as the two densities will be helpful in determining the overall mass of the mass adjustment member 208. The density of the shaft 204 is determined based on the overall length of the shaft 204 divided by the overall mass of the shaft 204; which in the current exemplary embodiment is between about 1.0 grams/inch and about 2.0 grams/inch, more preferably between about 1.10 grams/inch and 1.50 grams/inch, most preferably between about 1.15 grams/inch and about 1.25 grams/inch. The density of the grip 206, similar to above, is determined based on the overall length of the grip 206 divided by the overall mass of the grip 206; which in the current exemplary embodiment is between about 2.00 grams/inch and about 5.0 grams/inch, more preferably between about 2.10 grams/inch and about 4.0 grams/inch, and most preferably between about 2.20 grams/inch and about 3.5 grams/inch.

With the densities defined, the weight adjustment member 208, may generally have a total mass that is determined as a function of the density of the shaft 204 and the density of the grip 206. More specifically, the mass of the weight adjustment member 208 may generally be based off the relationship shown by Equation (1) below:

$$Mass_{wam} = F * \left(\frac{Density_{grip}}{Density_{shaft}}\right) \quad \text{Eq. (1)}$$

wherein $Mass_{wam}$=Mass of Weight Adjustment Member

F=Factor of Adjustment $Density_{shaft}$=Density of Shaft $Density_{grip}$=Density of Grip With the densities of the shaft 204 and grip 206 already discussed, the factor of adjustment used in this current exemplary embodiment of the present invention may generally be between about 2 to about 50, more preferably between about 8 to about 40, and most preferably between about 10 to about 30 in order to ensure that the mass associated to the weight adjustment member 208 strikes a proper balance to counteract the reduction in weight of the shaft 206. Given the Factor of adjustment described above, the overall mass of the weight adjustment member 206 may generally be between about 15 grams to about 100 grams, more preferably between about 15 grams to about 80 grams, and most preferably between about 20 grams to about 60 grams, all without departing from the scope and content of the present invention.

The mass of the weight adjustment member 208, as it relates to the overall density of the shaft 204 and the grip 206, is an important feature to emphasize here; as it differs significantly from the prior art attempts of blindly adding weight to the butt end of a grip in vacuum without any consideration of the overall impact on the performance of the golf club 200. The mere act of adding weight to the grip 206 end of a golf club 200 adds unnecessary overall weight, which by itself, could adversely affect the performance of the golf club 200 itself. However, the addition of the weight adjustment member 208 as a precise function of the mass and density of the shaft 204 and the grip 206 allows the current innovative golf club 200 to preserve its overall weight, in combination with the lightening the shaft 204; resulting in a golf club 200 that can be swung faster with the same amount of force.

To truly understand the benefits of the lightening of the shaft 206 and the addition of that weight via a weight adjustment portion 208 near the grip 206 portion of the golf club 200, a discussion regarding rotational moment of inertia is required. Rotational moment of inertia, in its basic concept, relates to the measurement of an object's resistance to rotation. More specifically, the golf swing may generally be comprised of two interrelated moments of inertia. The first moment of inertia relates to the ability of a golfer to swing the club around his body. This first type of moment of inertia, for discussion purposes, can be referred to as the $MOI_{golfer}$; determines the ability of the ability of the golfer to generate greater clubhead speed, yielding in an increase in overall distance. The second type of moment of inertia, relates to the ability of the golf club to rotate about its shaft axis 209 to control the face angle of the golf club head 202. This second type of moment of inertia, for discussion purposes, can be referred to as the $MOI_{shaft}$; determine the ability of the golfer to open and close the face angle, controlling the direction of the golf shot.

When the current invention reduces weight from the shaft 206 portion of the of the golf club 200, it reduces the $MOI_{golfer}$; allowing the golf club 200 to generate more club head 202 speed with the same amount of force. However, one of the side effect of this decreased weight in the shaft 206 portion produces a shaft that creates more lag, and is more whippy, hindering the ability of the club head 202 to return to the square position. In order to address this issue, the present invention incorporates the weight adjustment member 208 at the proximal end of the golf club 200, increasing the $MOI_{shaft}$ of the overall golf club 200 to counterbalance the instability caused by the reduction in $MOI_{golfer}$. Ultimately, the combination of the lightweight shaft 202 together with the readjustment of a precise amount of mass via the weight adjustment member 208, a golf club 200 can be swung with an increased speed without sacrificing feel and accuracy.

Figure 3:
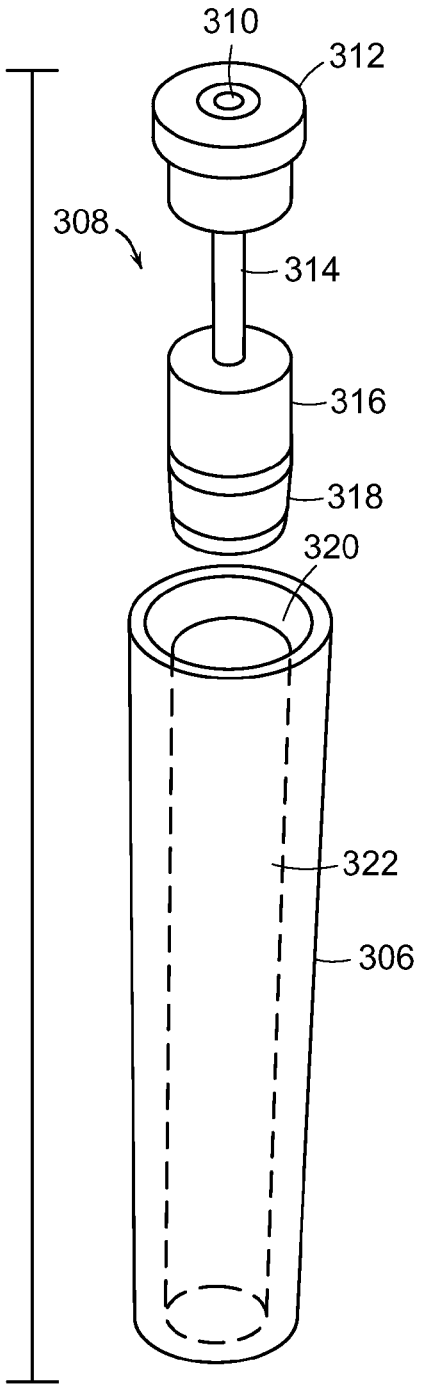
FIG. 3 of the accompanying drawings provides an exploded perspective view of a grip and a weight adjustment member in accordance with an exemplary embodiment of the present invention.

In order to further illustrate the weight adjustment member 208, FIG. 3 is provided here showing an exploded perspective view of a grip 306 with the weight adjustment member 308. In FIG. 3, the exploded view allows the various components of the weight adjustment member 308 such as the locking bolt 310, flange 312, connection rod 314, heavy weighted portion 316, and rubber stopper 318 to be shown in more detail. Additionally, FIG. 3 also shows a grip 306 having a recessed opening 320 that leads to a central cavity 322 that allows the grip 306 to wrap around the shaft (not shown).

The weight adjustment member 308, as shown in this current exemplary embodiment, generally fits into the proximal end of the grip 306 via the recessed opening 320. The flange 312 engages the recessed opening 320 to serve as a stopper for the weight adjustment member 308, preventing the weight adjustment member 308 to fall through the grip 306. Before the weight adjustment member 308 is installed, the heavy weighted portion 316 can be adjusted to be locked in at various locations along the connection rod 314, allowing the weighting of the weight adjustment member 308 to be altered based on the location. Once the desired location for the heavy weight portion 316 is selected, the weight adjustment member 308 can be inserted into the central cavity 322, after which the tightening of the locking bolt 310 will expand the rubber stopper 318 to push itself against the internal cavity of the shaft to secure the weight adjustment member 308 to the golf club.

It should be noted that although the general premise of the present invention shifts the weight savings from the shaft portion of the golf club towards the grip portion of the golf club, the precise execution of this weight change within the grip portion of the golf club is important to ensure optimal performance. Hence, the following figures will introduce several different embodiment of the present invention wherein the various precise placement of the weight placement within the grip portion of the golf club will be discussed. Moreover, the following figures will also discuss the specific relationship to determine how much weight will be used, the placement of the weight, and the relationship of the weight placement together with the amount of weight used.

Figure 4:
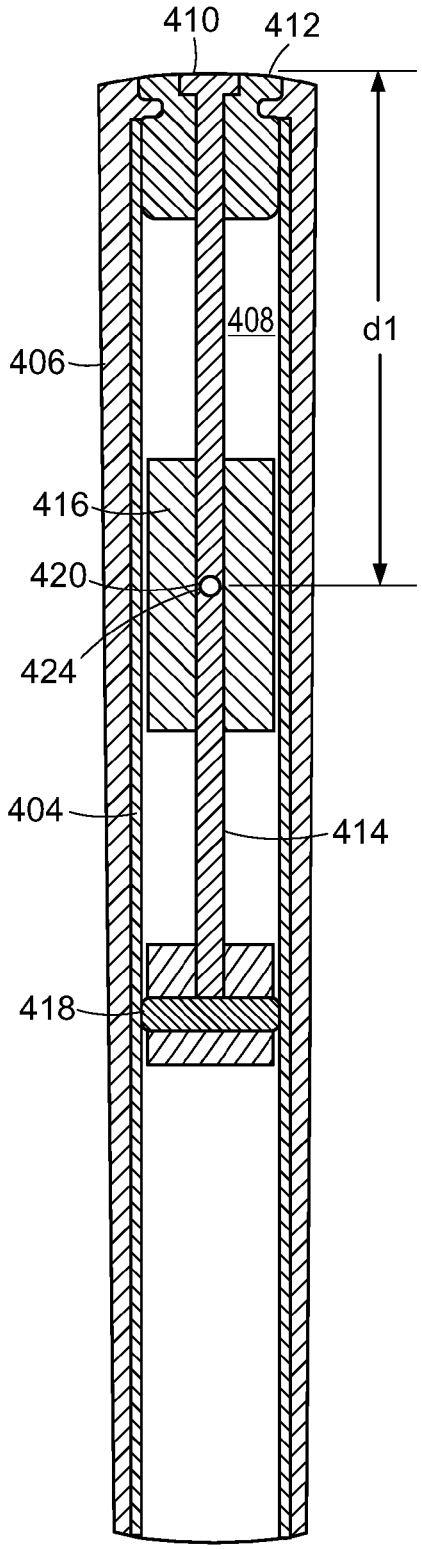
FIG. 4 of the accompanying drawings provides a cross-sectional view of a grip having a weight adjustment member in accordance with an exemplary embodiment of the present invention.

FIG. 4 of the accompanying drawings shows a cross-sectional view of the grip 406 in accordance with one exemplary embodiment of the present invention. This cross-sectional view shown in FIG. 4 show in more detail how the weight adjustment member 408 attaches to an internal circumference of the grip 406 via an expansion of the rubber stopper 418 against an internal wall profile of the shaft 404. More specifically, the rubber stopper 418 expands against the internal wall profile of the shaft 404 when the locking bolt 410 is tightened; securing the entire weight adjustment member 408 to the golf club. More importantly, FIG. 4 of the accompanying drawings shows the weight adjustment member 408 being installed in the grip 406 end of the golf club, with the heavy weighted portion 416 placed near the central portion of the connection rod 414. It should be noted that in this current exemplary embodiment of the present invention, the placement of the heavy weighted portion 416 along the connection rod 414 is determined based on a grip centroid 420. Grip centroid 420, as referred to in this current exemplary embodiment of the present invention, relates to an arbitrary location defined at a distance d1 of 4 inches away from the butt end of the grip 406; creating a reference point from which the placement of the heavy weighted portion 416 my be directed. This distance d1 of 4 inches, although may seem arbitrary on it's surface, is actually determined based on the average hand position of a golfer on the grip; symbolizing the center of the golfer's grip. The center of the golfer's grip is important in the placement of the heavy weighted portion 416, as it captures the ability of the golfer to turn the golf club over and controls the face angle of the club face during impact.

In this current exemplary embodiment of the present invention, the heavy weighted portion 416 is placed at or substantially near the grip centroid 420. More specifically, it can be said that the center of gravity 424 of the heavy weighted portion 416 is placed substantially near the grip centroid 420, creating a more neutral weight placement for adjusting for the changes in the ball flight. Because the mass of the heavy weighted portion 416 constitutes a majority of the mass of the weight adjustment member, this particular embodiment also yields a center of gravity of the weight adjustment member 408 at a point that is substantially near the grip centroid 420.

Figure 5:
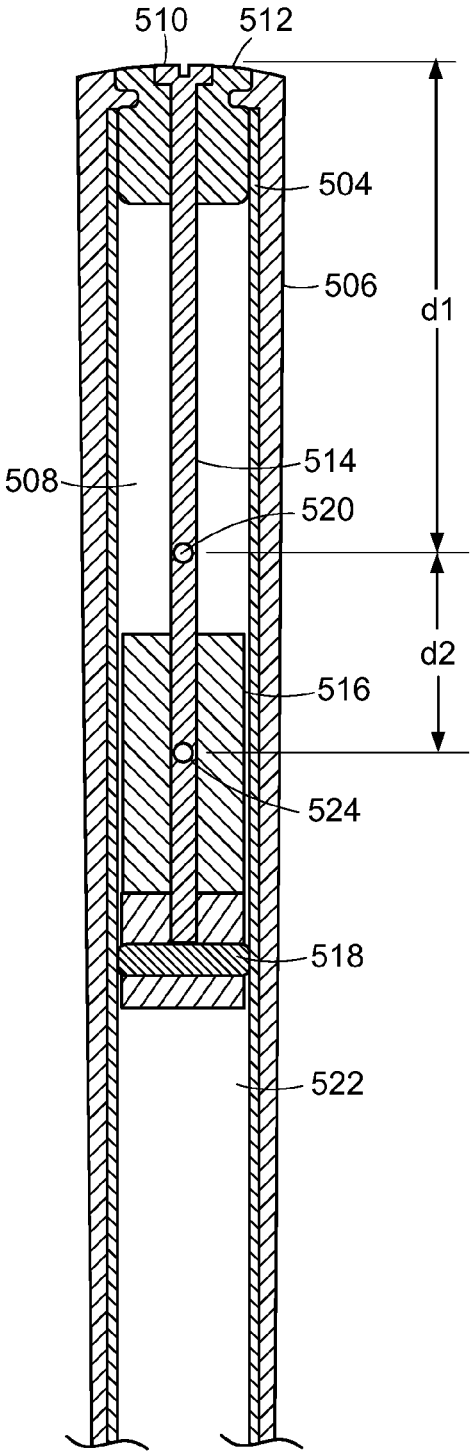
FIG. 5 of the accompanying drawings provides a cross-sectional view of a grip having a weight adjustment member in accordance with an alternative embodiment of the present invention.

FIG. 5 of the accompanying drawings shows a cross-sectional view of the weight adjustment member 508 installed in an alternative embodiment of the present invention. In this alternative embodiment shown in FIG. 5, it should be noted that the heavy weighted portion 516 is placed at bottom portion of the connection rod 514, strategically locating the heavy weighted portion 516 at a precise location within the cavity 522 of the grip 506. Alternatively speaking, it can be said that the heavy weighted portion 516 is placed away from the golfer relative to the grip centroid 520. More specifically, the center of gravity 524 of the heavy weighted portion 516 is placed at a distance d2 away from the grip centroid 520. The distance d2, as referred to in this current exemplary embodiment of the present invention, may generally be between about 0.5 inches to about 3.5 inches, more preferably between about 1.0 inches to about 3.0 inches, and most preferably between about 1.5 inches to about 2.5 inches. Although the exact formula used to determine the location of the heavy weighted portion 516 will be discussed in further detail later, it is worthwhile to note here that in this current exemplary embodiment, the placement of the heavy weighted portion 516 at the bottom of the grip 506 will generally mean that the majority of the weight will be just ahead of the golfer's hands within the grip 506, yielding a very different result than if the weight is behind the golfer's hands within the grip 506. Alternatively speaking, it can be said that the center of gravity of the weight adjustment member 508 may be placed ahead of the golfer's hands in this embodiment. Similar to the discussion above regarding how the heavy weighted portion 516 dominates the mass of the weight adjustment member 508, this embodiment generally yields a center of gravity of the weight adjustment member 508 being placed on a club head side of the grip centroid 520.

Figure 6:
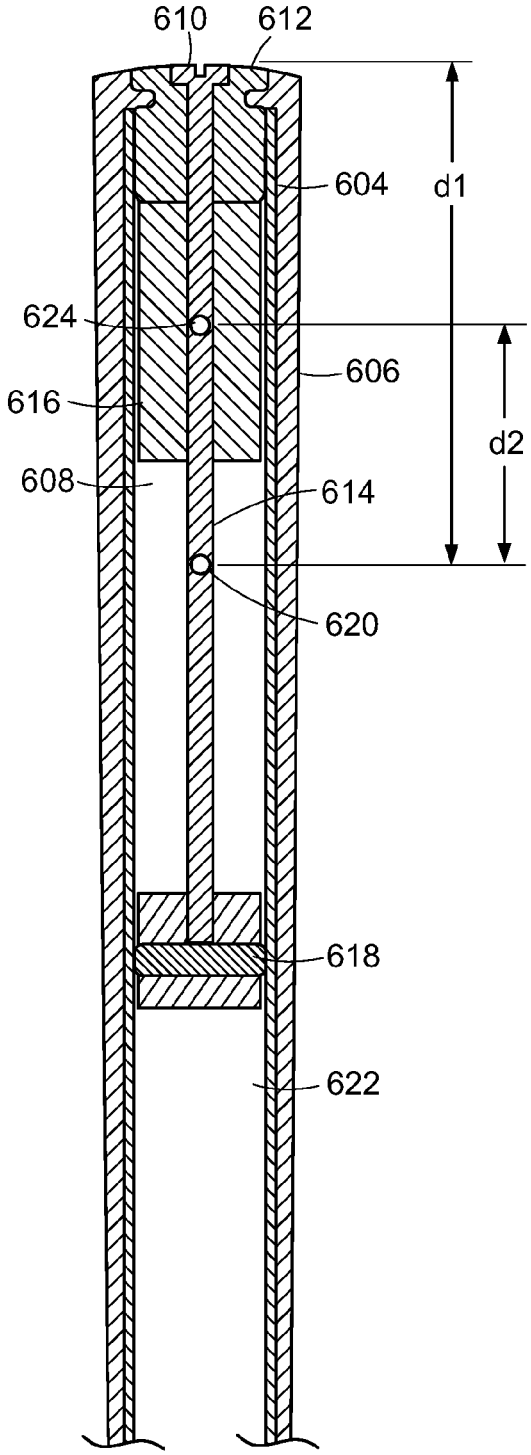
FIG. 6 of the accompanying drawings provides a cross-sectional view of a grip having a weight adjustment member in accordance with a further alternative embodiment of the present invention.

FIG. 6 of the accompanying shows the alternative embodiment of the present invention, wherein the heavy weight portion 616 is placed at the top of the grip 606, resulting in a weight placement that is behind the golfer's hands within the grip 606. Alternatively speaking, it can be said that the heavy weighted portion 616 is placed away from the golfer relative to the grip centroid 620. More specifically, the center of gravity 624 of the heavy weighted portion 616 is placed at a distance d2 away from the grip centroid 620. The distance d2, as referred to in this current exemplary embodiment of the present invention, may generally be between about 0.5 inches to about 3.5 inches, more preferably between about 1.0 inches to about 3.0 inches, and most preferably between about 1.5 inches to about 2.5 inches. With the heavy weight portion 616 locked in at a position that is behind the golfer's hand, a majority of the mass of the weight adjustment member 608 is moved behind the golfer's hand. Alternatively speaking, it can be said that the center of gravity of the weight adjustment member 608 maybe placed behind the golfer's hand in this embodiment. Similar to the discussion above regarding how the heavy weighted portion 616 dominates the mass of the weight adjustment member 608, this embodiment generally yields a center of gravity of the weight adjustment member 608 being placed on a grip side of the grip centroid 620.

It is worth noting here that due to the fact that the distances d2 may generally be 0.5 inches to about 3.5 inches, more preferably between about 1.0 inches to about 3.0 inches, and most preferably between about 1.5 inches to about 2.5 inches in all embodiments discussed above, it can be said that the center of gravity of the weight adjustment members 408, 508, and 608 is located no more than 3.5 inches on each side of the grip centroid 420, 520, and 620 respectively.

Due to the draw bias and fade bias adjustment that could result from the placement of the weights, the current inventive golf club could also incorporate an adjustable hosel mechanism to account for any changes in trajectory that may result from the incorporation of the weight adjustment member. More details regarding the functionality of the adjustable hosel mechanism can be found in U.S. Pat. No. 7,997,997, the disclosure of which is incorporated by reference in its entirety.

In addition to the placement of the center of gravity of the heavy weighted portion 406, 506, and 606 at the grip fulcrum 420, ahead of the grip fulcrum 520, and behind the grip fulcrum 620 respectively; the exact placement of the heavy weighted portion can be further defined as a function of the distance and the amount of weight added, all as a function of the total mass of the weight adjustment member. In order to show this relationship between the weight adjustment member, heavy weighted portion, and the location distances d2, Equation (2) is provided below.

$$Mass_{hwp} * \text{Distance}(d2) = \frac{Mass_{wam}}{R} \qquad \text{Eq. (2)}$$

wherein $Mass_{wam}$=Mass of weight adjustment member

R=Ratio of Swingweights $Mass_{hwp}$=Mass of Heavy weighted portion

Distance(d2)=Distance from CG of Heavy weighted portion to Grip Fulcrum

In this current example, the Ratio of Swingweights (R) may generally be about 0.3, and the Mass of weight adjustment member is known from above to be between about 15 grams to about 100 grams, more preferably between about 25 grams to about 75 grams, and most preferably between about 35 grams to about 50 grams. With that in mind, the mass of the weight adjustment member can range from about 5 grams to about 90 grams without departing from the scope and content of the present invention, depending on its distance (d2) from the grip fulcrum. In this current exemplary embodiment of the present invention, the mass of the weight adjustment member increases as the distance from the grip fulcrum decreases, and the mass of the weight adjustment member decreases as the distance from the grip fulcrum increases; with the potential distance (d2) from the grip fulcrum already previously constrained at between about 0.5 inches to about 3.5 inches, more preferably between about 1.0 inches to about 3.0 inches, and most preferably between about 1.5 inches to about 2.5 inches.

Figure 7:
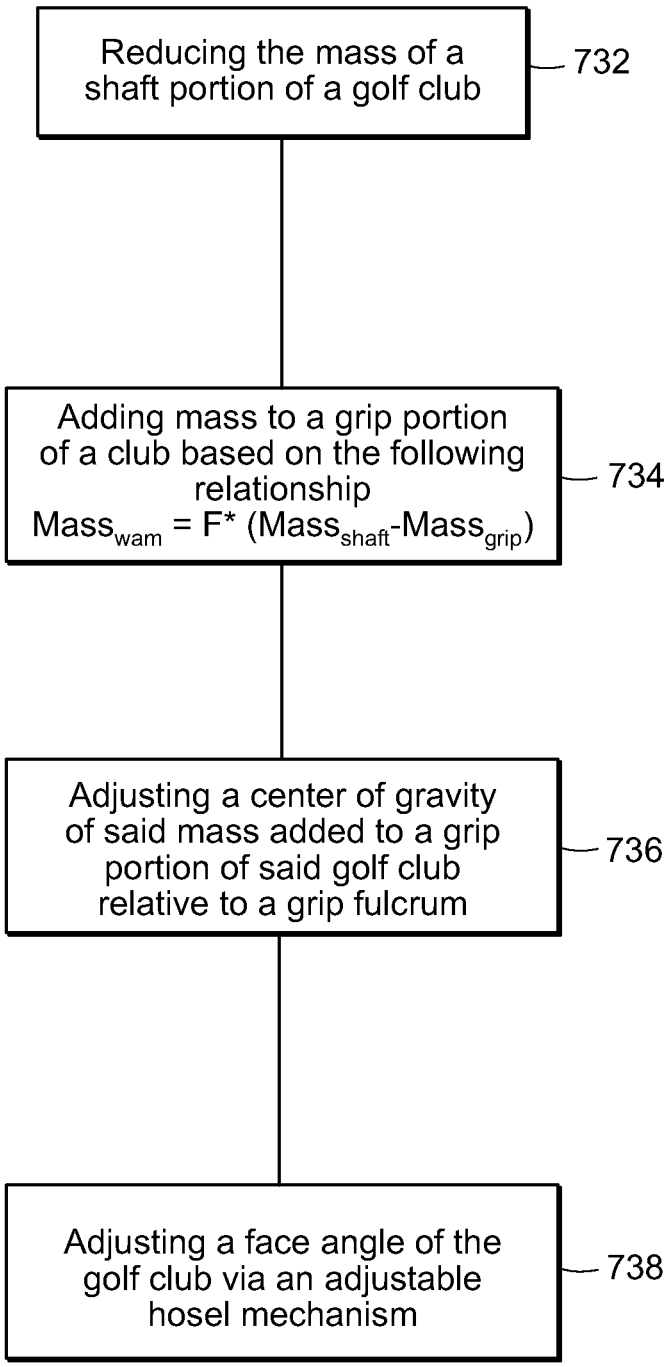
FIG. 7 of the accompanying drawings provides a flowchart diagram of a method of fitting in accordance with an exemplary embodiment of the present invention.

Based on all the potential adjustment possibilities discussed above, it can be seen that the current inventive golf club can also serve as a method of fitting to help a golfer determine a preferred combination amongst all of the potential settings described above to achieve a desirable goal. More specifically, FIG. 7 of the accompanying drawings shows a flow chart diagram describing the current contemplated fitting methodology. In step 732, the fitting methodology starts off by reducing the mass of a shaft portion of a golf club. In the current invention, the amount of mass reduces may generally be between about 10 grams to about 30 grams. The exact methodology to calculate the reduction in mass may generally relate to the discussion above that pertain to the overall weight of the shaft as a function of the overall clubhead weight. Generally, in order to reduce the mass of the shaft, in step 732, the methodology generally involves replacing the golfer's current shaft with a lighter weight version of the same shaft to eliminate other variables.

After the mass of the shaft is reduced in step 732, mass is added to the grip portion of the golf club in step 734 based on the relationship $$Mass_{wam} = F * \left(\frac{Density_{grip}}{Density_{shaft}}\right)$$

with a Factor of Adjustment (F) of between about 2 to about 50; to counteract the negative side effects that can result from the lightening of the shaft portion of the golf club. In step 734, the mass is generally added to the grip portion of the golf club via a weight adjustment member, attached to the butt end of the golf club itself Once the overall mass of the weight adjustment member is determined in step 734, the center of gravity location of said weight adjustment member is adjusted relative to a grip fulcrum. In this step, the exact location of the center of gravity of the weight adjustment member is determined via a movement in a heavy weighted portion that can move along a connecting rod. More specifically, the location and mass of the center of gravity of the heavy weighted portion is determined from its distance to the grip fulcrum, based on the relationship $$Mass_{hwm} * \text{Distance}(d2) = \frac{Mass_{wam}}{R},$$

to further precisely adjust for the undesirable effects that could result from the incorporation of the lightweight shaft that increases clubhead speed.

Finally, in step 738, further adjustment of the golf club to compensate for the undesirable effects of a lightweight shaft is possible with the usage of an adjustable hosel mechanism. More specifically, in rare situations where a further adjustment is needed, the golfer can attach the shaft to the club head at a different angle, altering the face angle of the golf club head by about 2 degrees, all without departing from the scope and content of the present invention.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting form the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A method of adjusting a golf club comprising:

adjusting a center of gravity of a weight adjustment member by locking a heavy weighted portion of said weight adjustment member at a preferred location on a connection rod of said weight adjustment member;

installing said weight adjustment member into a grip end of said golf club;

wherein said golf club comprises a shaft and a grip located at said grip end of said shaft and wherein said weight adjustment member comprises a flange, a locking bolt, and a rubber stopper;

wherein installing said weight adjustment member comprises inserting said weight adjustment member inside said shaft until a portion of said grip resides in an annular channel formed in said flange, and tightening said locking bolt, expanding said rubber stopper against said shaft, securing said weight adjustment member to said golf club;

adjusting a face angle of said golf club via an adjustable hosel mechanism;

wherein said weight adjustment member has a mass ($Mass_{wam}$) based on the relationship $$Mass_{wam} = F * \left( \frac{Density_{grip}}{Density_{shaft}} \right),$$

having a Factor of Adjustment (F) between about 10 to about 30;

wherein said shaft has a shaft mass of between about 60 grams to about 100 grams; and wherein said grip has a mass of about 45 grams to about 55 grams.

2. The method of adjusting a golf club of claim 1, wherein said heavy weighted portion comprises a majority of said weight adjustment member.

3. The method of adjusting a golf club of claim 2, wherein said weight adjustment member comprises a mass between about 15 to 100 grams.

4. The method of adjusting a golf club of claim 3, wherein said weight adjustment member comprises a mass between about 25 to 75 grams.

5. The method of adjusting a golf club of claim 4, wherein said weight adjustment member comprises a mass between about 35 to 50 grams.

6. The method of adjusting a golf club of claim 2, wherein adjusting a center of gravity of said weight adjustment member comprises adjusting the location of said heavy weighted portion along said weight adjustment member, wherein said heavy weighted portion is adjusted relative to a grip fulcrum located 4 inches away from a butt end of said golf club according to the relationship $$Mass_{hwp} * \text{Distance}(d2) = \frac{Mass_{wam}}{R},$$

wherein said distance (d2) is the distance from the center of gravity of said heavy weighted portion from said grip fulcrum, wherein $Mass_{hwp}$ is the mass of said heavy weighted portion, and wherein R is a ratio of swingweights.

7. The method of adjusting a golf club of claim 6, wherein said ratio of swingweights (R) is approximately 0.3.

8. The method of adjusting a golf club of claim 6, wherein said distance (d2) comprises a distance between 0 and 3.5 inches.

9. The method of adjusting a golf club of claim 8, wherein said distance (d2) comprises a distance between 0 and 3.0 inches.

10. The method of adjusting a golf club of claim 9, wherein said distance (d2) comprises a distance between 0 and 2.5 inches.

* * * * *